US012075861B2

(12) United States Patent
Tang

(10) Patent No.: US 12,075,861 B2
(45) Date of Patent: Sep. 3, 2024

(54) BIONIC AIR-CONDITIONING GARMENT

(71) Applicant: Xiaohua Tang, Wuhu (CN)

(72) Inventor: Xiaohua Tang, Wuhu (CN)

( * ) Notice: Subject to any disclaimer, the term of this patent is extended or adjusted under 35 U.S.C. 154(b) by 179 days.

(21) Appl. No.: 17/888,610

(22) Filed: Aug. 16, 2022

(65) Prior Publication Data

US 2023/0380518 A1 Nov. 30, 2023

(30) Foreign Application Priority Data

May 26, 2022 (CN) ..... 202210589012.7

(51) Int. Cl.
*A41D 13/005* (2006.01)
*A41D 1/00* (2018.01)
*A41D 31/102* (2019.01)

(52) U.S. Cl.
CPC ..... *A41D 13/0053* (2013.01); *A41D 1/002* (2013.01); *A41D 31/102* (2019.02)

(58) Field of Classification Search
CPC ..... A41D 13/0053; A41D 13/005; A41D 13/0056; A41D 1/002; A41D 31/02; A41D 31/12
See application file for complete search history.

(56) References Cited

U.S. PATENT DOCUMENTS

2011/0048048 A1* 3/2011 Gielda ..... F25B 1/06 62/259.3
2020/0329788 A1* 10/2020 Su ..... A41D 13/0053

* cited by examiner

*Primary Examiner* — Lionel Nouketcha
(74) *Attorney, Agent, or Firm* — Daniel M. Cohn; Howard M. Cohn

(57) ABSTRACT

A bionic air-conditioning garment, includes an air-conditioning garment body, a smart watch, and wireless temperature and humidity sensing sensors. A cooling water conveying system is disposed in each of seven block areas. The smart watch is connected to the controller through a wireless communication device. When a water pump works, liquid in a backpack water bag is transported to an outer layer of the air-conditioning garment body through labyrinth drip irrigation belts, and dispersed to the outer layer of the air-conditioning garment body. The outer layer of the air-conditioning garment body is hydrophilic to quickly expand water, so that the liquid expands to form a moisture permeable layer on the air-conditioning garment body. Under irradiation of external natural wind and sun, the bionic air-conditioning garment absorbs heat through gasification and evaporation of the liquid, which energy efficiency ratio is large and heat dissipation and cooling effects are better.

10 Claims, 5 Drawing Sheets

BIONIC AIR-CONDITIONING GARMENT

TECHNICAL FIELD

The present disclosure relates to a technical field of garments, and in particular to a bionic air-conditioning garment.

BACKGROUND

In an environment of high-temperature and high-humidity, human body regulates body temperature through sweating. People are still sweaty and hot when outside, even in thin and cooling shirts and shorts, which is unbearable. Thus, if there are conditions to stay in an air-conditioning room, people may never want to stay outside for a moment, which brings a lot of inconvenience and distress for people's work, study, life, especially for working outside. Moreover, many important outdoor activities have to be reluctantly chosen to take place in a weather which is neither cold nor hot.

Workers, patrols, outdoor climbing people, outdoor fishing people, or people who work and have fun outside need to wear garments to work, and the garments people wore further need to protect against solar ultraviolet rays. As the temperature rises, the human body sweats and the body temperature rises, leading to heat stroke for the workers or people who work outside, resulting in inability to work. Existing air-conditioning garments are disposed with compressors or fans on surfaces of the garments for cooling the human body, but the fans on the existing air-conditioning garments have poor cooling effect. What's more, directly blowing on the human body may evaporate sweat of the human body and may lead to water loss in the human body. The present disclosure provides a bionic air-conditioning garment based on human body sweating and human body temperature rise, where the air-conditioning garment simulates the human body sweating and prevents the human body from sweating.

SUMMARY

A technical problem to be solved by the present disclosure is to overcome above technical defects, and provides a bionic air-conditioning garment having high wearing comfort and fast heat dissipation.

In order to achieve above purposes, technical solutions adopted by the present disclosure are as follows.

The present disclosure provides a bionic air-conditioning garment, including an air-conditioning garment body and a smart watch. The air-conditioning garment body is made of a unidirectional moisture-guiding fabric. The unidirectional moisture-guiding fabric is formed through interweaving a hydrophobic fabric and a hydrophilic fabric or directly through the hydrophilic fabric, where the hydrophilic fabric is treated on one side with an oil-repellent and water-repellent finishing agent. The unidirectional moisture-guiding fabric forms a double-layer structure. The double-layer structure includes an inner layer and an outer layer, where the inner layer is configured to be attached to human skins and the outer layer is exposed to the outside. The inner layer has hydrophobicity, and the outer layer has hydrophilicity. A backpack water bag is disposed on an outer side of the air-conditioning garment body. A solar panel is disposed on an outer side of the backpack water bag. A solar cell and a controller are disposed on a surface of the backpack water bag. The air-conditioning garment body is divided into seven block areas, and the seven block areas include a front chest, a rear back, a waist, and four limbs. A cooling water conveying system is disposed in each of the seven block areas. The cooling water conveying system includes a water pump. An outlet of the water pump is connected to a silica gel pipeline. An inlet of the water pump is communicated with the backpack water bag through a pipe. A plurality of labyrinth drip irrigation belts are disposed on an outer side of the silica gel pipeline. A water through hole is defined in each of the plurality of the labyrinth drip irrigation belts. A first labyrinth, a second labyrinth, and a third labyrinth are disposed in each of the plurality of the labyrinth drip irrigation belts. The second labyrinth and the third labyrinth are respectively communicated with the first labyrinth. A communicating hole is defined between the first labyrinth and the water through hole a water outlet is defined in one end of each of the second labyrinth and the third labyrinth, the water outlet is distal from the first labyrinth. The smart watch is connected to the controller through a wireless communication technology. Wireless temperature and humidity sensing sensors are disposed between the plurality of the labyrinth drip irrigation belts and the air-conditioning garment body.

Furthermore, the water pump and the controller are electrically connected. The smart watch controls flow of the water pump in the cooling water conveying system and turns on or off the water pump in the cooling water conveying system through receiving, analyzing, and processing data of the wireless temperature and humidity sensing sensors and data of the smart watch, and then feeding back the data of the wireless temperature and humidity sensing sensors and the data of the smart watch to the controller.

Furthermore, the solar panel charges the solar cell, and the solar cell provides power for the controller and the water pump.

Furthermore, the solar panel is a flexible solar panel.

Furthermore, the smart watch detects respiration, heartbeat, blood oxygen concentration, external temperature, and humidity of the human body.

Furthermore, an antibacterial coating is disposed on the air-conditioning garment body.

Furthermore, a silica gel waterproof layer is disposed on a surface of each of the wireless temperature and humidity sensing sensors.

Furthermore, the wireless temperature and humidity sensing sensor and the smart watch are wirelessly connected with the controller.

Furthermore, the plurality of the labyrinth drip irrigation belts are irregularly distributed or orderly disposed.

Furthermore, the plurality of the labyrinth drip irrigation belts are attached to an outer layer of the air-conditioning garment body, where the plurality of the labyrinth drip irrigation belts are disposed in areas of the front chest, the rear back, the waist, and the four limbs of the air-conditioning garment body.

Beneficial effects of the present disclosure are as follows.

When the water pump works, the water pump transports liquid in the backpack water bag to the labyrinth drip irrigation belts through the silica gel pipeline, and then drives the liquid to pass through the plurality of the labyrinth drip irrigation belts to the outer layer of the air-conditioning garment body, and further disperse the liquid to the outer layer of the air-conditioning garment body. The outer layer of the air-conditioning garment body is hydrophilic to quickly expand the liquid, so that the liquid expands to form a moisture permeable layer on the air-conditioning garment body. Under irradiation of external natural wind and sun, the bionic air-conditioning garment absorbs heat through gasification and evaporation of the liquid, which energy efficiency ratio is large and heat dissipation and cooling effects are better. The bionic air-conditioning garment absorbs heat and cools the human body and outer side areas of the human body, meanwhile, the bionic air-conditioning garment simulates a human body perspiration system, which achieves cooling of the human body.

The bionic air-conditioning garment of the present disclosure is connected with the controller through the smart watch to control work and flow of the water pump, which regulates amounts of heat dissipation in real time, and further achieves real-time controllability.

REFERENCE NUMBER IN THE DRAWINGS

Figure 1:
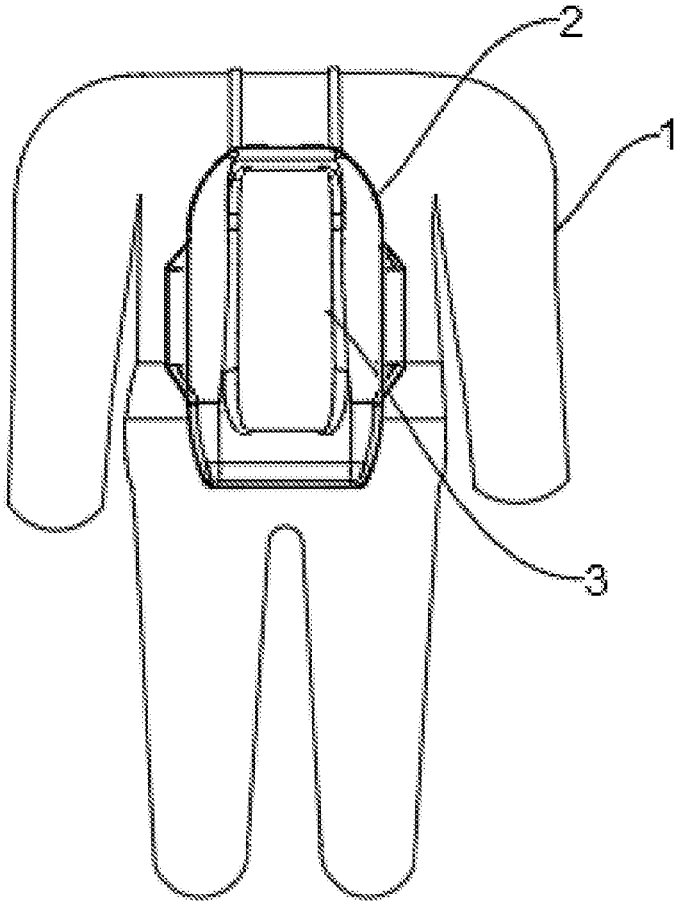
FIG. 1 is a schematic diagram of a front view of the bionic air-conditioning garment according to one embodiment of the present disclosure.
Figure 2:
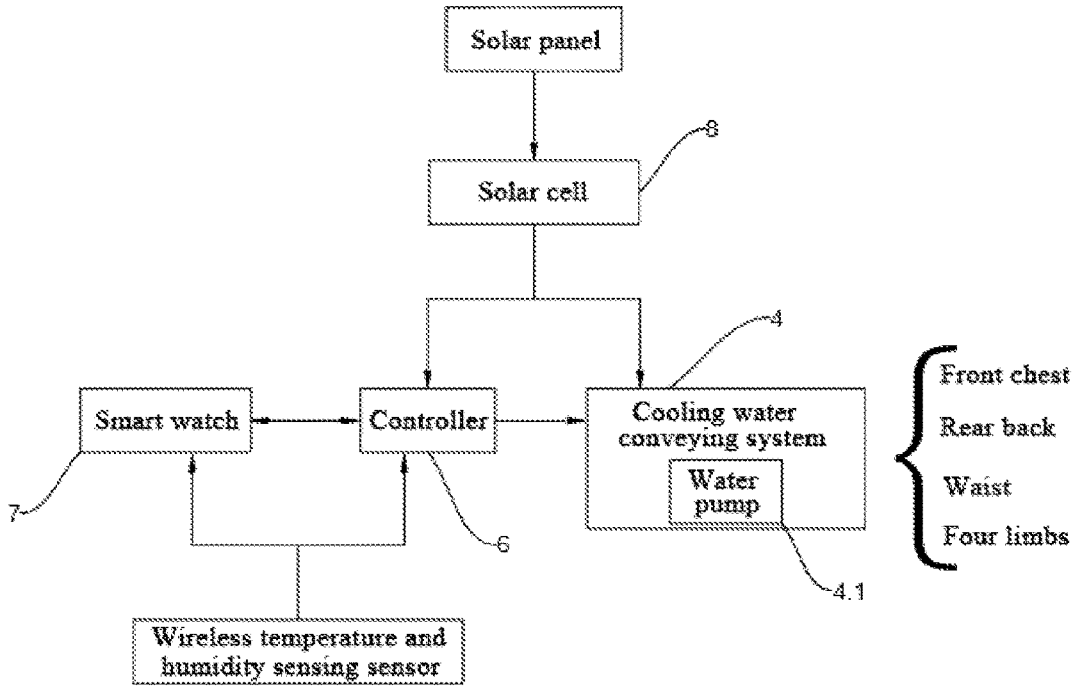
FIG. 2 is a principle schematic diagram of the bionic air-conditioning garment according to one embodiment of the present disclosure.
Figure 3:
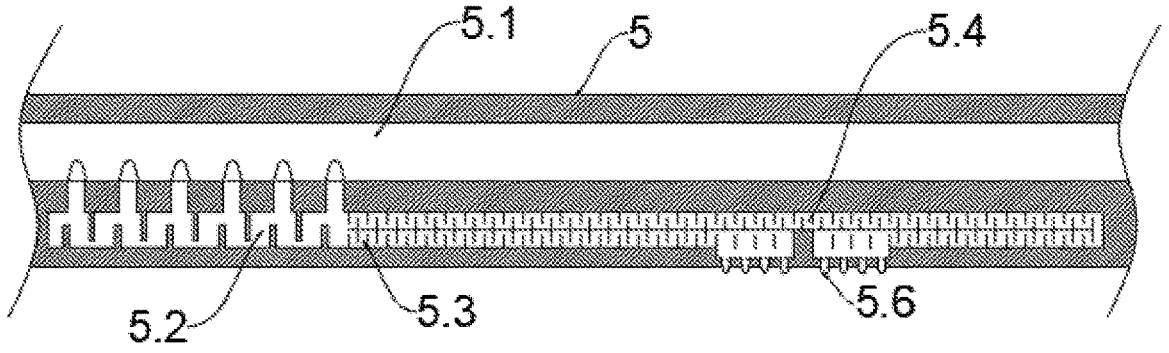
FIG. 3 is a cross-sectional schematic diagram of one of labyrinth drip irrigation belts of the bionic air-conditioning garment according to one embodiment of the present disclosure.

1. air-conditioning garment body; 2. backpack water bag; 3. solar panel; 4. cooling water conveying system; 4.1. water pump; 4.2. silica gel pipeline; 5. labyrinth drip irrigation belts; 5.1. water through hole; 5.2. first labyrinth; 5.3. second labyrinth; 5.4. third labyrinth; 5.5. communicating holes; 5.6. water outlet; 6. controller; 7. smart watch; 8. solar cell; 9. wireless temperature and humidity sensing sensors.

DETAILED DESCRIPTION

Specific embodiments of the present disclosure are further described below with reference to accompanying drawings. The same portions are designated with the same reference numerals. It should be noted that words "front", "rear", "left", "right", "upper", and "lower" used in following descriptions refer to directions in the drawings. Terms "inner" and "outer" respectively refer to directions toward or distal from a geometric center of a particular component.

In order to make contents of the present disclosure more readily understood, technical solutions in the embodiments of the present disclosure are clearly and completely described below with reference to the accompanying drawings in the embodiments of the present disclosure.

As shown in FIGS. 1-6, a bionic air-conditioning garment includes an air-conditioning garment body 1 and a smart watch 7. A hidden zipper is disposed on a front surface of the air-conditioning garment body 1, and people open the air-conditioning garment body 1 through the hidden zipper, thereby putting the air-conditioning garment body 1 on the human body. The air-conditioning garment body 1 is made of a unidirectional moisture-guiding fabric. The unidirectional moisture-guiding fabric is formed through interweaving a hydrophobic fabric and a hydrophilic fabric or directly through the hydrophilic fabric, where the hydrophilic fabric is treated on one side with an oil-repellent and water-repellent finishing agent. The unidirectional moisture-guiding fabric forms a double-layer structure, and the double-layer structure includes an inner layer which is configured to be attached to skin and an outer layer which is exposed to the outside. The inner layer has hydrophobicity, and the outer layer has hydrophilicity.

Figure 5:
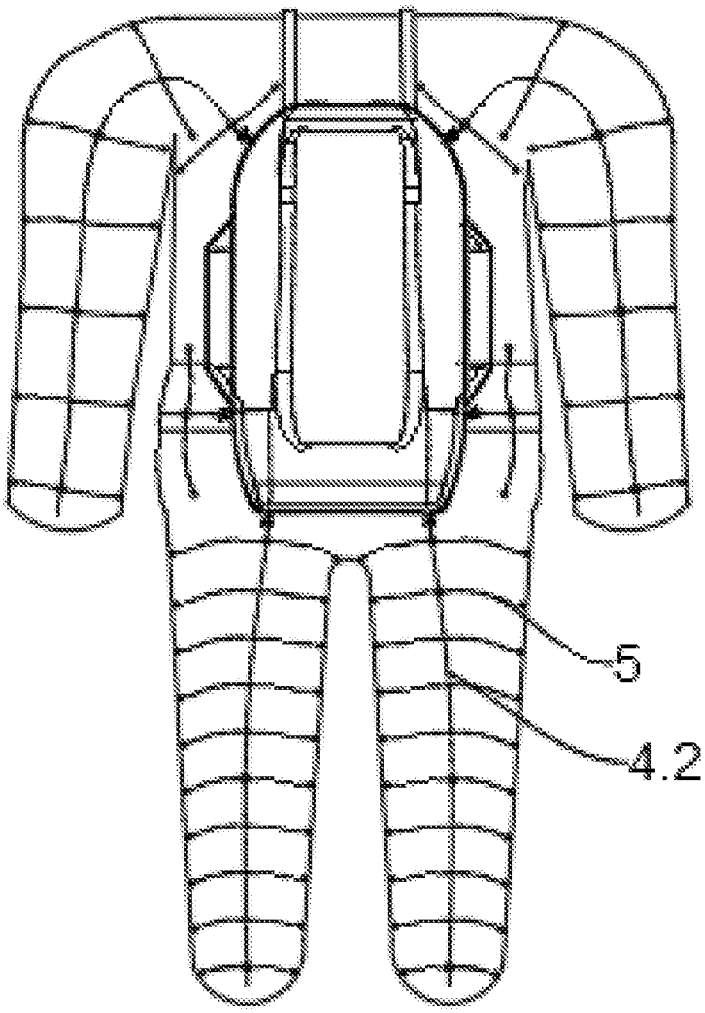
FIG. 5 is a schematic diagram of an arrangement of a silica gel pipeline and the labyrinth drip irrigation belts of the cooling water conveying system of the bionic air-conditioning garment according to one embodiment of the present disclosure.
Figure 6:
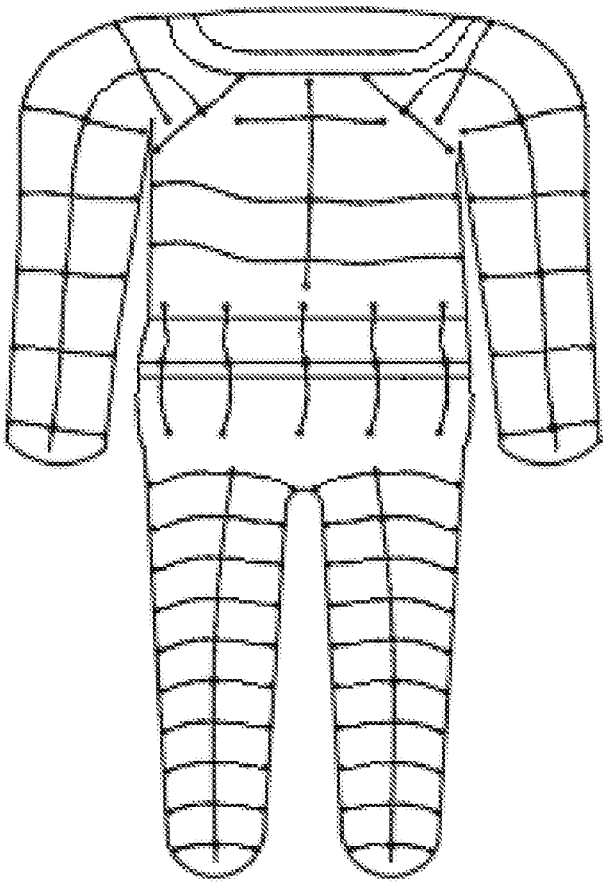
FIG. 6 is a schematic diagram of a rear view of the arrangement of the silica gel pipeline and the labyrinth drip irrigation belts of the cooling water conveying system of the bionic air-conditioning garment according to one embodiment of the present disclosure.

A backpack water bag 2 is disposed on an outer side of the air-conditioning garment body 1. A solar panel 3 is disposed on an outer side of the backpack water bag 2. A solar cell 8 and a controller 6 are disposed on a surface of the backpack water bag 2. The air-conditioning garment body 1 is divided into seven block areas, and the seven block areas includes a front chest, a rear back, a waist, and four limbs of a human body. A cooling water conveying system 4 is disposed in each of the seven block areas. The cooling water conveying system 4 includes a water pump 4.1. An outlet of the water pump 4.1 is connected to a silica gel pipeline 4.2. An inlet of the water pump 4.1 is communicated with the backpack water bag 2 through a pipe. A plurality of labyrinth drip irrigation belts 5 are disposed on an outer side of the silica gel pipeline 4.2, as shown in FIGS. 5-6.

People pour water into the backpack water bag 2. In actual use, the smart watch 7 is wirelessly connected to the controller 6 through a wireless communication technology, such as BLUETOOTH. The smart watch 7 operates the controller 6 to perform comprehensive analysis on data according to respiration, heartbeat, blood oxygen concentration, external temperature, and humidity of a human body. The wireless temperature and humidity sensing sensors 9 and the smart watch 7 are wirelessly connected with the controller 6. A silica gel waterproof layer is disposed on a surface of each of the wireless temperature and humidity sensing sensors 9. The wireless temperature and humidity sensing sensors 9 are disposed at tail ends of the labyrinth drip irrigation belts, or junctions of the silica gel pipeline 4.2 and ends of the labyrinth drip irrigation belts. The wireless temperature and humidity sensing sensors 9 sense the humidity and the temperature of the air-conditioning garment body 1. When the humidity or the temperature is abnormal, the humidity or the temperature is transmitted to the smart watch 7. The smart watch 7 operates the controller 6 to control the water pump 4.1, so as to control flow rate of the water pump 4.1. When the water pump 4.1 works, the backpack water bag 2 stores 2-3 kilograms of liquid, and the liquid in the backpack water bag 2 is transported to an outer layer of the air-conditioning garment body 1 through the labyrinth drip irrigation belts 5. The liquid is dispersed in a first labyrinth 5.2 through communicating holes 5.5, then passes through a second labyrinth 5.3 and a third labyrinth 5.4. And finally, the liquid is dispersed to the outer layer of the air-conditioning garment body 1 through a water outlet 5.6 in a form of droplets to form a capillary effect. The outer layer of the air-conditioning garment body 1 is hydrophilic to quickly expand the liquid, so that the liquid expands to form a moisture permeable layer on the air-conditioning garment body 1. Under irradiation of external natural wind and sun, the bionic air-conditioning garment absorbs heat through gasification and evaporation of the liquid, which absorbs heat and cools the human body and outsides of the human body, and takes away the heat of the human body. The inner layer is hydrophobic, so that the inner layer remains dry, and the liquid of the outer layer cannot penetrate into the inner layer. Mint powder or perfume and the like are added into the backpack water bag 2 to make the water in the backpack water bag 2 cooler and more fragrant.

A water through hole 5.1 is defined in each of the plurality of the labyrinth drip irrigation belts 5. The first labyrinth 5.2, the second labyrinth 5.3, and the third labyrinth 5.4 are disposed in each of the plurality of the labyrinth drip irrigation belts 5. The second labyrinth 5.3 and the third labyrinth 5.4 are respectively communicated with the first labyrinth 5.2. The communicating holes 5.5 are defined between the first labyrinth 5.2 and the water through hole 5.1. The water outlet 5.6 is defined in one end, distal from the first labyrinth 5.2, of the second labyrinth 5.3 and the third labyrinth 5.4. The smart watch 7 is connected to the controller 6 through the wireless communication device. The wireless temperature and humidity sensing sensors 9 are disposed between the labyrinth drip irrigation belts 5 and the air-conditioning garment body 1.

Figure 4:
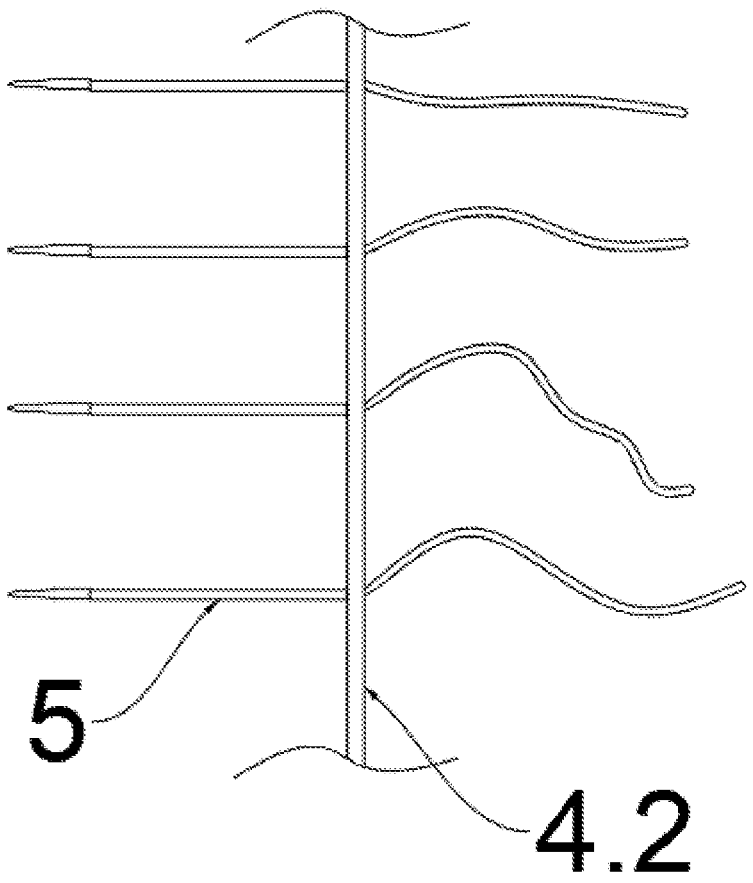
FIG. 4 is a schematic diagram of a cooling water conveying system of the bionic air-conditioning garment according to one embodiment of the present disclosure.

The plurality of labyrinth drip irrigation belts 5 are attached to an outer layer of the air-conditioning garment body 1, where the plurality of labyrinth drip irrigation belts 5 are disposed in areas of the front chest, the rear back, the waist, and the four limbs of the air-conditioning garment body 1. The plurality of the labyrinth drip irrigation belts 5 are dispersed to the seven block areas of the rear back, the front chest, the waist, and the four limbs of the air-conditioning garment body 1. The labyrinth drip irrigation belts 5 are irregularly distributed or orderly disposed. As shown in FIG. 4, irregular distribution or orderly arrangement of the labyrinth drip irrigation belts 5 are wrapped around the rear back, the front chest, the waist, and the four limbs of the air-conditioning garment body 1 to form a distribution similar to a capillary network. The water pump 4.1 and the controller 6 are electrically connected. The smart watch 7 controls flow of the water pump 4.1 and turns on or off the water pump 4.1 in the cooling water conveying system 4 through receiving, analyzing, and processing data of the wireless temperature and humidity sensing sensors 9 and data of the smart watch 7 and feeding back the data of the wireless temperature and humidity sensing sensor 9 and the data of the smart watch 7 to the controller 6. In a specific implementation, the water pump 4.1 of the cooling water conveying system 4 of each of the seven block areas is controlled by the smart watch 7 to respectively control the flow and controlled to turn on or off. The smart watch 7 operates the controller 6 to perform the comprehensive analysis on the data according to the respiration, the heartbeat, the blood oxygen concentration, the external temperature, and the humidity of the human body. Then, the smart watch 7 operates the controller 6 to control the water pump 4.1 in different areas, and controls the flow of the water pump 4.1 and turns on or off the water pump 4.1.

In a specific implementation, a wireless power supply module and a receiving module are disposed on the backpack water bag 2. The wireless power supply module is connected with the solar cell. The receiving module is turned on at intervals, for example, run-up time of each interval is 2 seconds or 5 seconds. The receiving module generates electromagnetic waves to form current pulses, and the current pulses are released in reverse data and transmitted to the smart watch 7.

The water pump 4.1 is electrically connected to the controller 6, and the controller 6 controls the flow rate of the water pump 4.1. The solar panel 3 charges the solar cell 8, and the solar cell 8 provides power for the controller 6 and the water pump 4.1. The solar panel 3 absorbs illumination of external sun to charge the solar cell 8, the solar cell 8 stores power, and the solar cell 8 provides the power to the controller 6 and the water pump 4.1.

An antibacterial coating is disposed on the air-conditioning garment body 1.

A working principle of the present disclosure is as follows:

Putting the air-conditioning garment body on the human body, and connecting the smart watch to the controller. The smart watch operates the controller to perform the comprehensive analysis on the data according to the respiration, the heartbeat, the blood oxygen concentration, the external temperature, and the humidity of the human body. Then, the smart watch operates the controller to control the water pump, and controls the flow of the water pump. When the water pump works, the liquid in the backpack water bag is transported to the outer layer of the air-conditioning garment body through the labyrinth drip irrigation belts, and dispersed to the outer layer of the air-conditioning garment body. The outer layer of the air-conditioning garment body is hydrophilic to quickly expand water, so that the liquid expands to form a moisture permeable layer on the air-conditioning garment body. Under irradiation of external natural wind and sun, the bionic air-conditioning garment absorbs heat through gasification and evaporation of the liquid, which absorbs the heat and cools the human body and outsides of the human body, so as to achieve a cool situation for the human body.

Embodiment 1

Putting the air-conditioning garment body on the human body, and connecting the smart watch to the controller. The smart watch operates the controller to perform the comprehensive analysis on the data according to the respiration, the heartbeat, the blood oxygen concentration, the external temperature, and the humidity of the human body. When the temperature of the wireless temperature and humidity sensing sensors is high and the humidity of the wireless temperature and humidity sensing sensors is low in the four limbs areas, while other areas are normal, the smart watch automatically determines that the four limbs areas of the human body need heat dissipation, then operates the controller to turn on or increase the flow rate of the water pump in the cooling water conveying system in each of the four limbs of the air-conditioning garment body, and increases the flow rate of the water pump working in each of the four limbs of the air-conditioning garment body. When the water pump works, the liquid in the backpack water bag is transported to the outer layer of the air-conditioning garment body through the labyrinth drip irrigation belts, and dispersed to the outer layer of the air-conditioning garment body. The outer layer of the air-conditioning garment body is hydrophilic to quickly expand water, so that the liquid expands to form a moisture permeable layer on the air-conditioning garment body. Under the irradiation of the external natural wind and sun, the bionic air-conditioning garment absorbs heat through gasification and evaporation of the liquid, which absorbs the heat and cools the human body and outsides of the human body, so as to cool the four limbs of the human body.

Embodiment 2

Putting the air-conditioning garment body on the human body, and connecting the smart watch to the controller. The smart watch operates the controller to perform the comprehensive analysis on the data according to the respiration, the heartbeat, the blood oxygen concentration, the external temperature, and the humidity of the human body. When the temperature of the wireless temperature and humidity sensing sensors is high and the humidity of the wireless temperature and humidity sensing sensors is low in the four limbs of the air-conditioning garment body, while the temperature of the wireless temperature and humidity sensing sensors is low and the humidity of the wireless temperature and humidity sensing sensors is high in the rear chest, the front chest, and the waist of the air-conditioning garment body, the smart watch automatically determines that four limbs areas of the human body need heat dissipation, and areas of a rear chest, a front chest, and a waist of the human body do not need heat dissipation. Then, the smart watch operates the controller to turn on or increase the flow rate of the water pump in the cooling water conveying system in each of the four limbs of the air-conditioning garment body, and decreases the flow rate of the water pump in the areas of the rear chest, the front chest, and the waist of the air-conditioning garment body. The seven block areas of the air-conditioning garment body are adjusted according to actual conditions, which is more in line with the heat dissipation of the human body and imitates effect of perspiration and the heat dissipation of the human body. When the water pump works, the liquid in the backpack water bag is transported to the outer layer of the air-conditioning garment body through the labyrinth drip irrigation belts, and dispersed to the outer layer of the air-conditioning garment body. The outer layer of the air-conditioning garment body is hydrophilic to quickly expand the liquid, so that the liquid expands to form a moisture permeable layer on the air-conditioning garment body. Under the irradiation of the external natural wind and sun, the bionic air-conditioning garment absorbs heat through gasification and evaporation of the liquid, which absorbs the heat and cools the human body and outsides of the human body, so as to cool the four limbs of the human body.

Above descriptions are only the preferred embodiments of the present disclosure, and are not intended to limit the present disclosure. Any modifications, equivalent replacements and improvements made within spirit and principle of the present disclosure shall be included in a protection scope of the present disclosure.

What is claimed is:

1. A bionic air-conditioning garment, comprising:

an air-conditioning garment body; and a smart watch;

wherein the air-conditioning garment body is made of a unidirectional moisture-guiding fabric, the unidirectional moisture-guiding fabric is formed through interweaving a hydrophobic fabric and a hydrophilic fabric or directly through the hydrophilic fabric;

wherein the hydrophilic fabric is treated on one side with an oil-repellent and water-repellent finishing agent;

wherein the unidirectional moisture-guiding fabric forms a double-layer structure, and the double-layer structure comprises an inner layer and an outer layer, wherein the inner layer is configured to be attached to human skins and the outer layer is exposed to the outside; the inner layer has hydrophobicity, and the outer layer has hydrophilicity;

a backpack water bag disposed on an outer side of the air-conditioning garment body;

a solar panel disposed on an outer side of the backpack water bag;

a solar cell and a controller disposed on a surface of the backpack water bag;

wherein the air-conditioning garment body is divided into seven block areas, and the seven block areas comprise a front chest, a rear back, a waist, and four limbs; wherein a cooling water conveying system disposed in each of the seven block areas; the cooling water conveying system comprising a water pump, wherein an outlet of the water pump is connected to a silica gel pipeline, an inlet of the water pump is communicated with the backpack water bag through a pipe, a plurality of labyrinth drip irrigation belts are disposed on an outer side of the silica gel pipeline, a water through hole is defined in each of the plurality of the labyrinth drip irrigation belts;

wherein a first labyrinth, a second labyrinth, and a third labyrinth are disposed in each of the plurality of the labyrinth drip irrigation belts; the second labyrinth and the third labyrinth are respectively communicated with the first labyrinth, wherein a communicating hole is defined between the first labyrinth and the water through hole;

wherein a water outlet is defined in one end of each of the second labyrinth and the third labyrinth, the water outlet being distal from the first labyrinth;

wherein the smart watch is connected to the controller through a wireless communication technology, and wireless temperature and humidity sensing sensors are disposed between the plurality of the labyrinth drip irrigation belts and the air-conditioning garment body.

2. The bionic air-conditioning garment according to claim 1, wherein the water pump and the controller are electrically connected; and the smart watch controls flow of the water pump in the cooling water conveying system and turns on or off the water pump in the cooling water conveying system through receiving, analyzing, and processing data of the wireless temperature and humidity sensing sensors and data of the smart watch; and then feeding back the data of the wireless temperature and humidity sensing sensors and the data of the smart watch to the controller.

3. The bionic air-conditioning garment according to claim 2, wherein the smart watch detects respiration, heartbeat, blood oxygen concentration, external temperature, and humidity of the human body.

4. The bionic air-conditioning garment according to claim 2, wherein the wireless temperature and humidity sensing sensors and the smart watch are wirelessly connected with the controller.

5. The bionic air-conditioning garment according to claim 1, wherein the solar panel charges the solar cell, and the solar cell provides power for the controller and the water pump.

6. The bionic air-conditioning garment according to claim 5, wherein the solar panel is a flexible solar panel.

7. The bionic air-conditioning garment according to claim 1, wherein an antibacterial coating is disposed on the air-conditioning garment body.

8. The bionic air-conditioning garment according to claim 1, wherein a silica gel waterproof layer is disposed on a surface of each of the wireless temperature and humidity sensing sensors.

9. The bionic air-conditioning garment according to claim 1, wherein the plurality of the labyrinth drip irrigation belts are irregularly distributed or orderly disposed.

10. The bionic air-conditioning garment according to claim 1, wherein the plurality of the labyrinth drip irrigation belts are attached to an outer layer of the air-conditioning garment body, wherein the plurality of the labyrinth drip irrigation belts are disposed in areas of the front chest, the rear back, the waist, and the four limbs of the air-conditioning garment body.

* * * * *